United States Patent [19]

Carter

[11] 4,242,168

[45] Dec. 30, 1980

[54] LABELING MACHINE

[75] Inventor: Sidney T. Carter, Shrewsbury, Mass.

[73] Assignee: A-T-O Inc., Cleveland, Ohio

[21] Appl. No.: 33,880

[22] Filed: Apr. 27, 1979

[51] Int. Cl.[3] ..... B65C 3/14

[52] U.S. Cl. ..... 156/357; 156/560; 156/568; 156/571

[58] Field of Search ..... 156/560, 567, 568, 571, 156/475, 357

[56] References Cited

U.S. PATENT DOCUMENTS

| | | | |
|---|---|---|---|
| 2,936,921 | 5/1960 | Schulz | 156/568 |
| 3,139,368 | 6/1964 | Flood | 156/542 |
| 3,723,228 | 3/1973 | Schaltegger | 156/568 |
| 3,865,671 | 2/1975 | Kronsder | 156/560 |
| 4,152,192 | 5/1979 | Zodrow | 156/560 |

FOREIGN PATENT DOCUMENTS

| | | | |
|---|---|---|---|
| 2843418 | 5/1978 | Fed. Rep. of Germany | 156/567 |

*Primary Examiner*—Douglas J. Drummond
*Attorney, Agent, or Firm*—Robert T. Gammons

[57] ABSTRACT

A labeling machine for gluing labels at one or both sides of bottles with provision for adjusting the inclination of the label transfer pads to approximately the inclination of the side surfaces of the bottles to which the labels are to be applied, including means for retracting the label magazine and removing some of the glue from the surface of the glue-applying roll in the absence of bottles or no bottles.

6 Claims, 7 Drawing Figures

LABELING MACHINE

BACKGROUND OF THE INVENTION

The labeling machine of this invention is of the kind wherein there are one or more pickers, for example, three, arranged to rotate about a common center relative to a glue-applying roll, a magazine and a label transfer drum arranged about the same center in such a way that the pickers, respectively, have contact with the surface of the glue-applying roll to receive a layer of glue, contact with the endmost label in a label magazine to pick a label from the magazine and contact with the label transfer drum where the labels are removed from the picker by clamp fingers carried by the transfer drum and moved by the latter into engagement with containers traveling along a path tangential to the label transfer drum. If the bottles or containers to which the labels to be applied are uniformly cylindrical from top to bottom, the labels may be readily moved into contact with the surfaces of the bottles or containers because of the tangential relation between the surface of the transfer drum and the surfaces of the containers traveling along relative thereto. If the containers, especially bottles, are of the kind having a body portion of one diameter and a tapering neck portion and it is desirable to apply labels both to the body portion and to the neck portion, provision must be made for moving the label-applying pads carried by the transfer drum for applying labels to the necks relative to those for applying labels to the body closer to the path of travel of the bottles in order to press the labels to the inclined surface. This has been done in the past by mounting the label-applying pads on pivotally-supported arms or on reciprocally-supported arms and extending the pads by pivotal movement or reciprocal movement of the arms to engage the labels with the inclined portions of the containers. Such an arrangement involves a complexity of mechanisms. It is the purpose of this invention to so employ the conventional arrangement of the pickers, glue-applying roll, magazine and label transfer roll as to enable applying labels to the perpendicular and inclined surfaces of containers without substantial modification and without having to employ pivotally movable or reciprocally movable pads and the mechanisms required to effect their movement. It is a further object of the invention to use in conjunction with the label-applying assembly of this invention means for retracting the label magazine in the event of a gap in the procession of containers or no containers to prevent waste of labels and simultaneously reduce the amount of glue on the glue-applying roll to prevent accumulation of an excess amount of glue on the picker surfaces.

SUMMARY OF THE INVENTION

The labeling apparatus of this invention comprises in combination conveyor means for moving containers in upright positions along a predetermined path and label-applying means supported along one or both sides of the conveyor means for applying labels to the body and neck portions of bottles or containers which have perpendicular and/or inclined surfaces constructed and arranged to be tilted to a position of inclination approximating that of the surfaces of the containers.

The label-applying means includes a glue roll, pickers for receiving glue from the glue roll, a label magazine from which labels are picked by the pickers and a label transfer drum provided with grippers and label-applying shoes for removing the glue-coated labels from the pickers and applying them to the containers. The label-applying shoes of the label transfer drum have arcuate surfaces for engagement with the surfaces of the containers and there is means for supporting the transfer drum carrying said label-applying shoes for tilting of its axis to an inclination approximating the inclination of the side surfaces of the containers so that the shoes have substantially rolling contact with both the vertical and inclined side surfaces of the containers. There is also means for supporting the transfer drum for movement toward and away from the conveyor for accommodating containers of varying diameter. The transfer drum comprises upper and lower sections to which the shoes are mounted and these are yieldable and of sufficient thickness to compensate for differences between the inclination of the drum and the surfaces to which the labels are to be applied. The means for supporting the label transfer drum to tilt it is a table mounted to the frame of the machine and means for raising one edge of the table upwardly relative to the other to dispose the axis of the label transfer drums at an angle corresponding substantially to the angle of inclination of the surfaces of the bottles. The picker, glue-applying roll and label magazine are also mounted to the table for movement in unison with the label-applying drum so that their relation remains the same throughout adjustment of the transfer drum to the inclination of the surface of the containers to which the labels are to be applied. The label magazine is supported on the table for retraction in the event there is a gap in the procession of containers or no containers and the glue-applying roll is equipped with a doctor blade which may be moved to a position to reduce the amount of glue on the surface of the glue applying roll at the instant that the label magazine is retracted.

The invention will now be described in greater detail with reference to the accompanying drawings, wherein.

Figure 1:
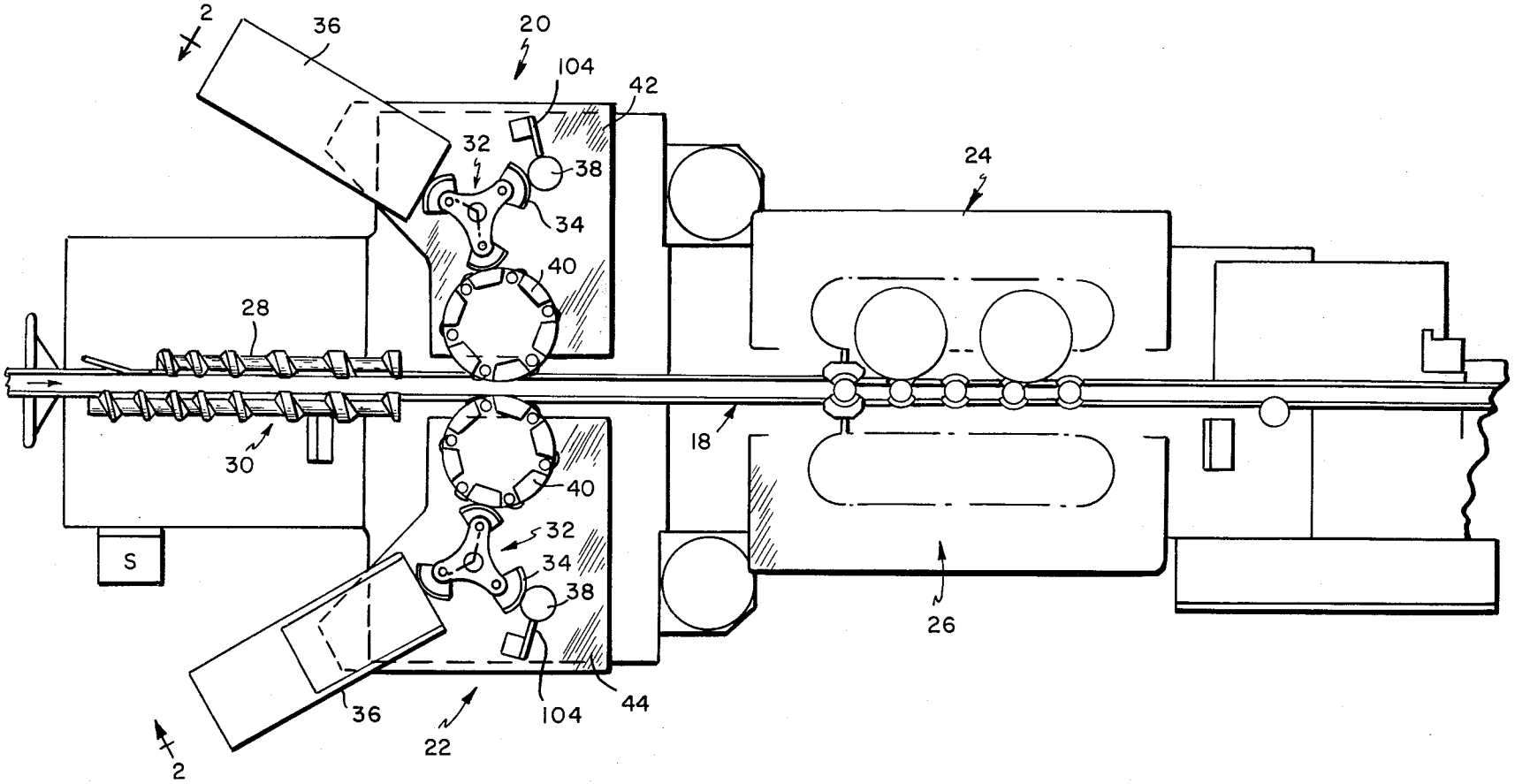
FIG. 1 is a plan view of a labeling machine with a portion of the delivery end omitted.
Figure 2:
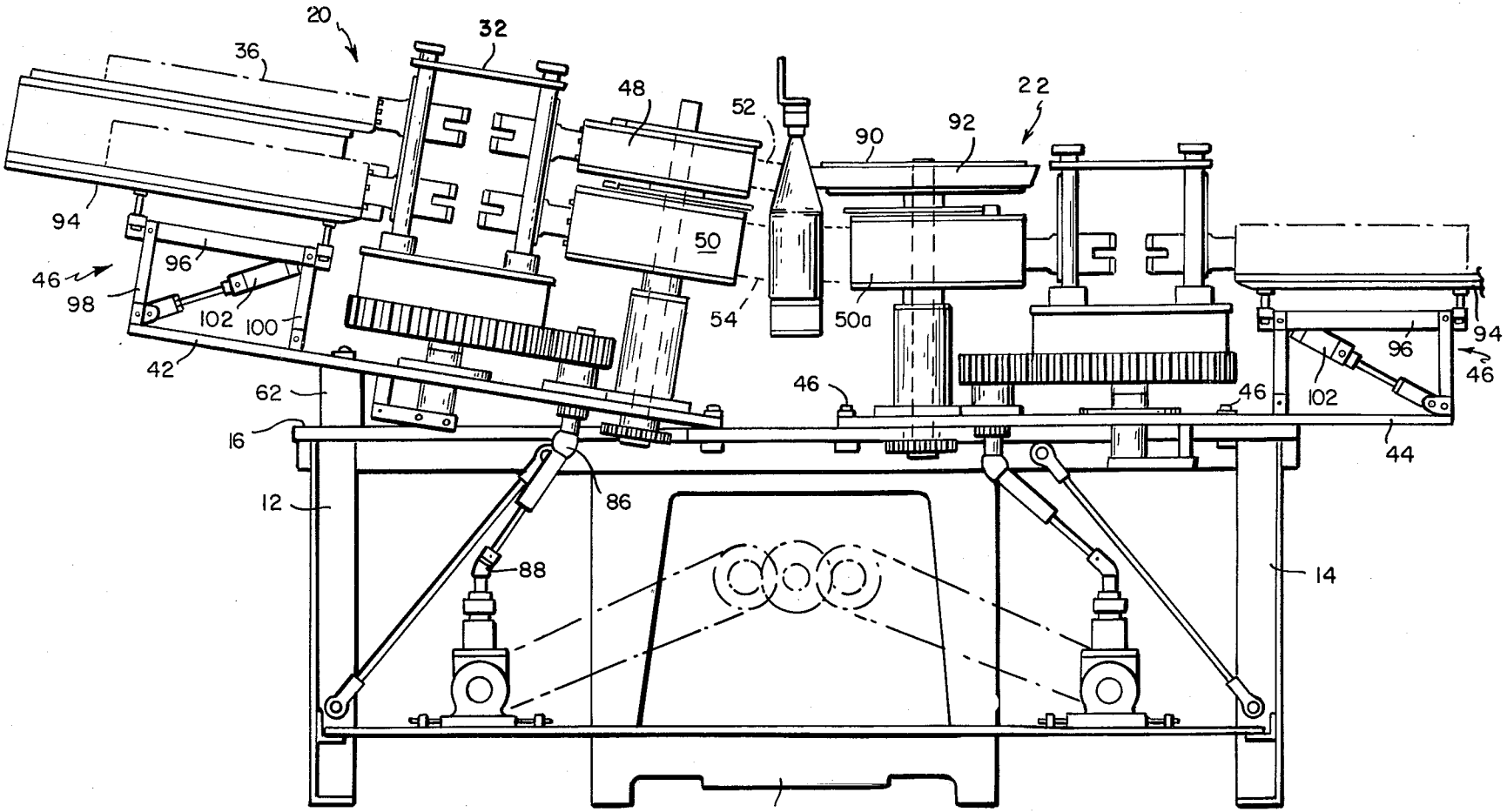
FIG. 2 is a transverse elevation taken on the line 2—2 of FIG. 1.

Referring to FIGS. 1 and 2 of the drawings, the machine has a base frame 10 and lateral extensions 12 and 14 provided with a flat tabletop 16 upon which are mounted a conveyor 18, label-applying means 20 and 22, one at each side of the conveyor 18, helical feed screws 28 and 30, one at each side of the conveyor for presenting the container to be labeled at uniformly-spaced intervals to the label-applying assembly and label-wiping assemblies 24,26, one at each side of the conveyor for wrapping the labels firmly in place following their application to the surfaces by the label transfer drum.

Each label-applying assembly comprises a picker 32 provided with three picker shoes 34, a label magazine 36, a glue-applying roll 38 and a label transfer drum 40.

The two label-applying assemblies are identical component-for-component and the components of each assembly are mounted to support plates 42 and 44 which are, respectively, mounted to the tabletop 16. The plate 42 is supported, as will appear hereinafter, to be tilted upwardly at an angle to the table 16. The plate 44 is fixed in a plane parallel to the tabletop 16 and securely fastened in this position by bolts 46.

Figure 3:
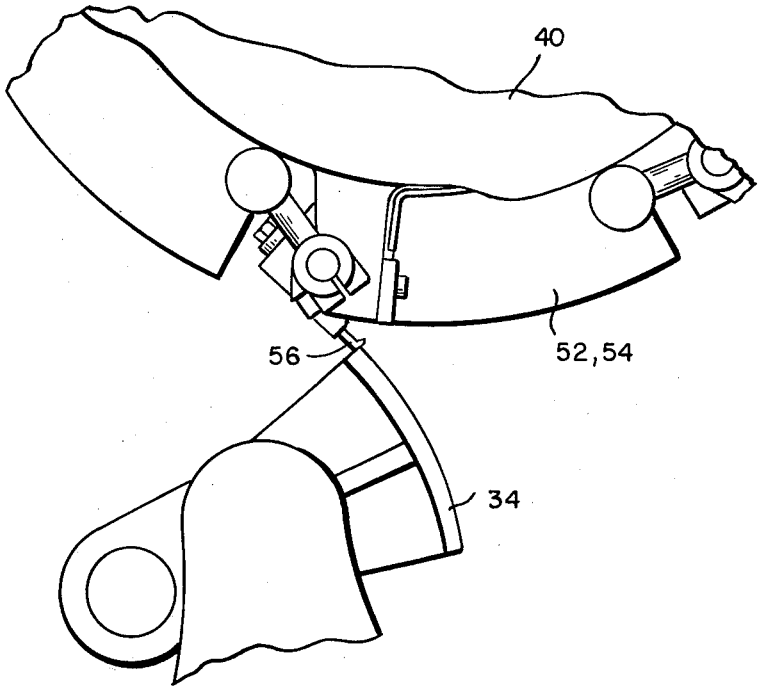
FIG. 3 is a fragmentary plan view showing a portion of the label transfer drum in a position about to remove a glue-coated label from a picker.

Referring specifically to the label-applying assembly mounted to the plate 42, FIG. 2, the picker assembly 32 is mounted on the plate for rotation about an axis which is perpendicular to the plate, the glue-applying roll 38 is mounted to the plate for rotation about an axis perpendicular thereto, and the label transfer drum 40 is mounted to the plate for rotation about an axis perpendicular thereto. The label magazine 36 is mounted by means of a collapsible support 46 parallel to the plate 42 for reciprocal movement into and out of position to supply labels to the picker shoes as they travel by the magazine. By this arrangement, that is, by supporting the component parts of the label-applying assembly on the tiltable plate 42, it is possible to position the axis of rotation of the label transfer drum at an inclination to the vertical so that the peripheral surfaces of the label transfer drum comprising an upper section 48 for applying labels to the necks of the containers and the lower section 50 for applying labels to the body of the containers can be positioned to have approximate rolling contact with the surfaces to which the labels are to be applied. The lack of exact parallelism between the surface of the transfer drum with both the vertical and inclined surfaces of the container is compensated for by the relatively thick cushion-like shoes 52 and 54 attached to the respective peripheral surfaces of the label transfer drum sections 48 and 50 as shown clearly in FIG. 2. Thus, it is that when the label transfer drum removes a glue-covered label from the picker shoe in conventional fashion as shown in FIG. 3 by clamp fingers 56 and transfers them into engagement with the body and neck portions of the container, they will be pressed firmly into position.

Figure 4:
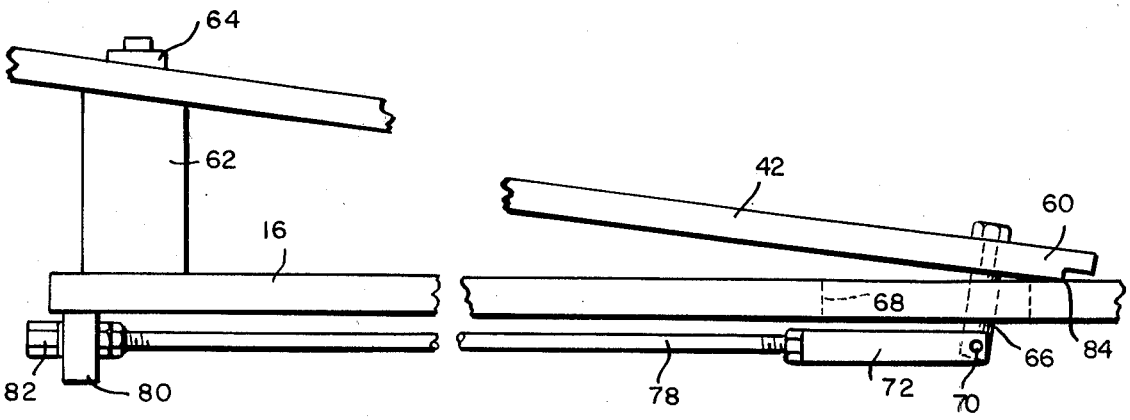
FIG. 4 is a fragmentary elevation of the common support for the picker, glue-applying roll, label magazine and label transfer drum and the means for effecting its angular and linear adjustment.

The plate 42 is supported so that its angular disposition may be varied to provide for the best possible transfer of labels to the surfaces of the containers depending upon the inclination of the surfaces with its inner edge 60 resting on the table 16 and its outer edge resting on posts 62 fastened to the underside by bolts 64, FIG. 4. At the inner edge of the plate 42, there are secured to the underside studs 66 which extend downwardly through slots 68 in the table 16. One end 70 of a link 72 is pivotally connected to the lower end of each stud and the opposite end is connected to one end of a threaded spindle 78, the opposite end of which is rotatably supported in a boss 80 at the underside of the table 16. By rotating the spindles 78, heads 82 being provided for this purpose, the studs 66 may be moved toward and away from the conveyor and, in turn, move the plate 42 toward and away from the conveyor to bring the label-applying drum closer to or move it further away from the conveyor for bottles of different diameter. Angular movement of the plate 42 is provided by tilting the plate 42 about the edge 84 as a fulcrum and either moving the posts 62 inwardly or outwardly or replacing them with posts of different length.

Universal couplings 86 and 88 or their equivalent are provided for connecting the drive for the picker and transfer drum to the main drive so as to permit plate 42 and the components supported thereby to be tilted angularly with respect to the supporting table 16.

The label-applying assembly 22 at the other side, the right side as seen in FIG. 2, differs from that at the left side in that the transfer drum has only a lower section **50*a* for applying labels to the bodies of the containers. The upper section is replaced with a support wheel 90 provided with a tire 92, the surface of which is inclined to have tangential contact with the sloping surface of the necks of the containers to prevent the containers from tipping over. The support wheel 90** is employed when no labels are to be applied to the neck at that side. However, if labels are to be applied, it would be replaced with an upper section the same as that at the left-hand side. If, on the other hand, no labels are to be applied, both the top and bottom sections may constitute supports.

The label magazine 36 at both sides are mounted to be retracted from the path of travel of the pickers upon platforms 94 bolted to supporting frames 96, the latter being, in turn, supported by pairs of legs 98,100 pivoted at their upper ends to the frame and at their lower ends to the platforms 42,44, respectively. A double-acting cylinder and piston assembly 102 connected diagonally to the lower sides of the legs 98 and to the upper ends of the legs 100 provides for pivoting the legs angularly away from the pickers while maintaining the parallel relationship of the magazine to its support. The cylinder and piston assemblies are actuated to retract the magazine in the absence of containers on the conveyor by sensing devices S arranged to detect the presence or absence of containers approaching the labeling assemblies.

Figure 5:
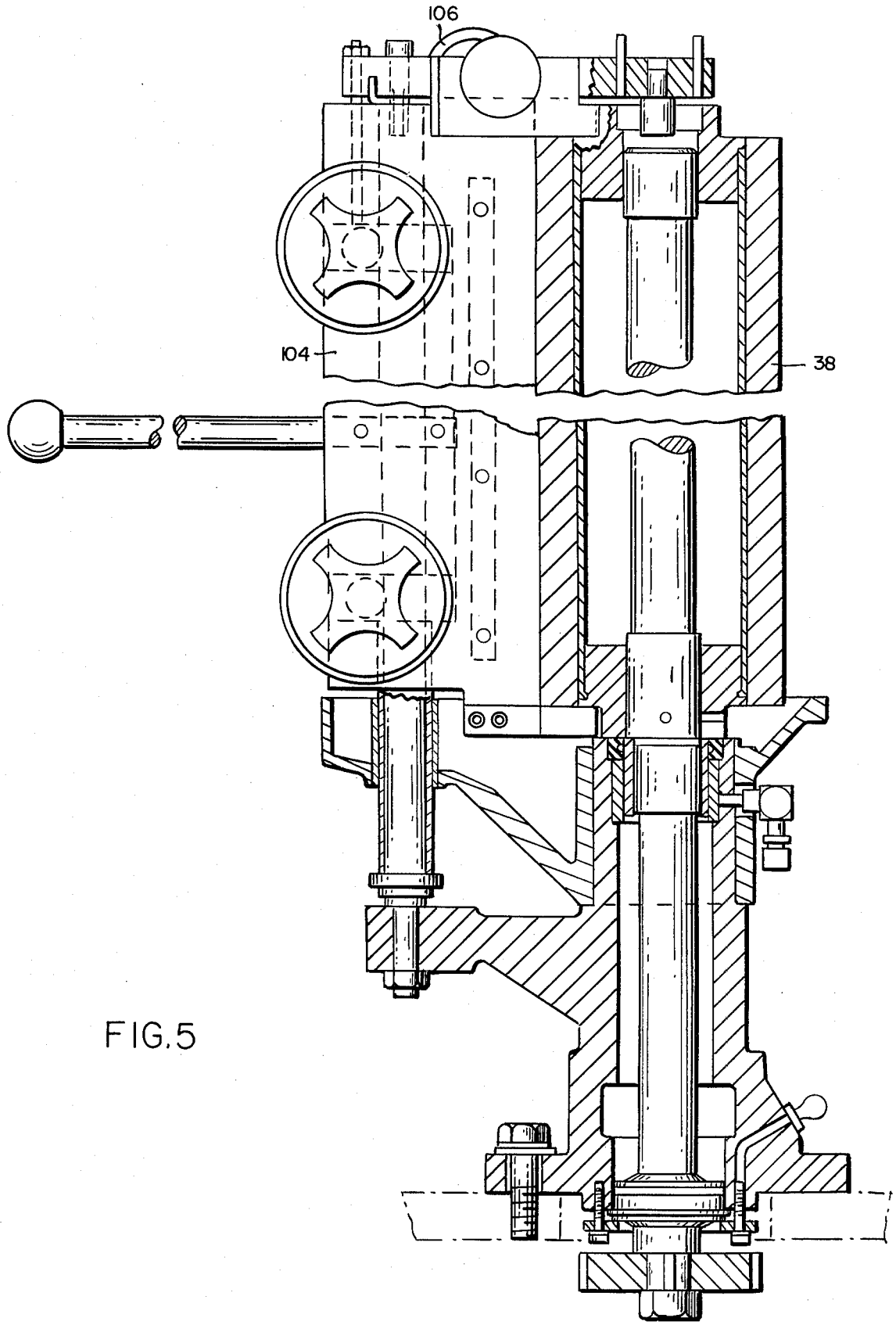
FIG. 5 is an elevation of the glue-applying roll to a much larger scale showing the doctor blade and means for moving it into and out of scraping engagement with the surface of the glue roll.
Figure 6:
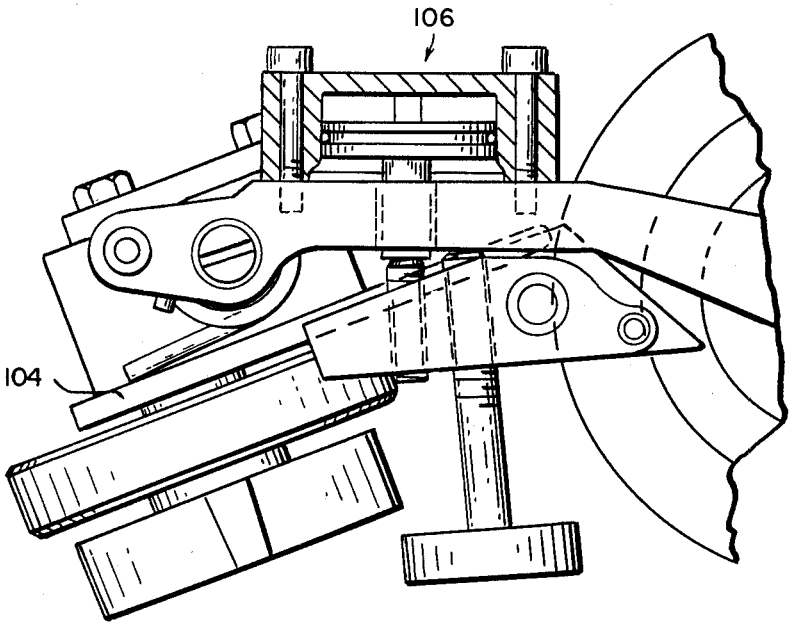
FIG. 6 is a plan view showing the doctor blade spaced from the surface of the glue-applying roll for labeling.
Figure 7:
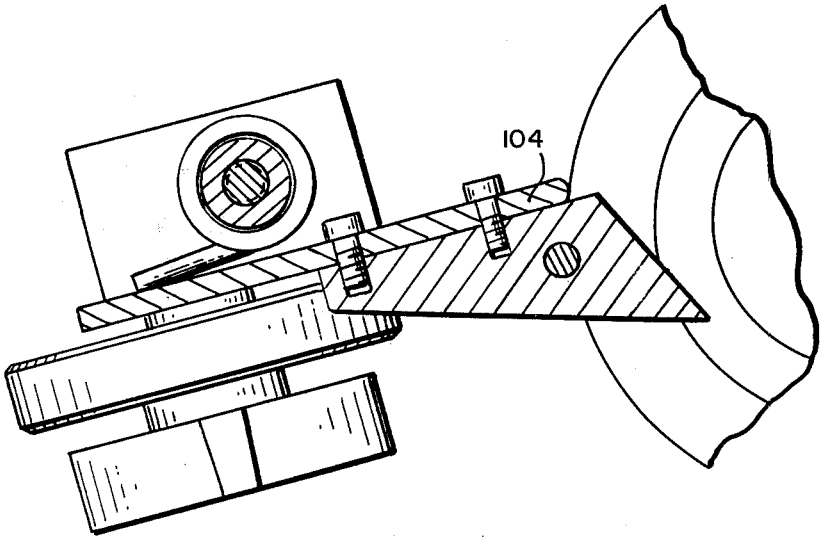
FIG. 7 shows the doctor blade positioned to reduce the amount of glue on the surface of the glue-applying roll during intervals of non-labeling.

Each of the glue-applying rolls is provided with a doctor blade 104 as shown in FIG. 5 so mounted that it can be moved from a position spaced from and parallel to the surface of the glue-applying roll to a position of scraping engagement therewith. At the first position, the blade controls the thickness of the glue on the surface of the glue-applying roll and at the second position, it reduces the amount of glue on the surface without completely removing it. The movement of the blade is effected through suitable linkage by a cylinder and piston assembly 106 connected to the cylinder and piston assembly 102 so that when air is supplied to the latter to withdraw the magazine, air is supplied to the former to move the doctor blade toward the glue-applying roll and vice versa.

The structural details of the mounting of the doctor blade for movement relative to the glue-applying roll are shown in my copending application Ser. No. 042,040 filed May 24, 1979 to which reference may be had for a more specific description of the doctor blade assembly as a whole.

It should be understood that the present disclosure is for the purpose of illustration only and includes all modifications or improvements which fall within the scope of the appended claims.

I claim:

1. In a labeling machine wherein a conveyor moves containers of the kind having vertical and inclined surfaces in upright positions along a predetermined path, a support adjacent said path, a shaft mounted on the support with its axis perpendicular thereto for rotation about its axis, transfer drums fixed to the shaft for rotation therewith and located thereon in positions such that their peripheral surfaces confront the vertical and inclined neck surface portions of containers resting on the conveyor, elastic pads positioned at spaced intervals peripherally of the drums for receiving labels from pickers and pressing them into engagement with the containers, clamp fingers on the drums, one associated with each pad, for receiving the labels from the pickers and releasing them as they are pressed into engagement with the containers, means mounting the support for tilting about an axis parallel to said path to position the axis of the shaft at an inclination to the vertical axis of the containers on the conveyor, means mounting the support for rectilinear movement at right angles to the conveyor to permit adjustment of the proximity of the pads to the path of movement for containers of different diameter and means for maintaining a driving connection with the shaft regardless of the position of the support.

2. A labeling machine according to claim 1 wherein there is a label magazine, a glue-applying roll and label picking means arranged on the support for supplying glue-coated labels to the pads on the transfer drums.

3. A labeling machine according to claim 2 comprising means supporting the magazine on the common support for movement away from the picker and wherein there is a doctor blade for controlling the thickness of the glue on the glue roll movable to a position to reduce the quantity of glue on the surface of the glue roll when not labeling and means operable to retract the magazine and simultaneously move the doctor blade to said non-labeling position.

4. A labeling machine according to claim 3 comprising means for retracting the label magazine in the event of a gap in the procession of containers or no containers and means for simultaneously reducing the quantity of glue on the surface of the glue-applying roll.

5. A labeling machine according to claim 4 wherein the means for retracting the label magazine comprises an actuator and a container sensing device wherein the means for retracting the label magazine comprises a pneumatically-actuated piston and cylinder assembly and a sensing device located to sense the presence or absence of containers and, in the absence of containers, initiating operation of said piston cylinder assembly.

6. A labeling machine according to claim 3 wherein the support for the magazine comprises a frame of rectangularly-arranged, pivotally-connected parts and an actuator connected between two diagonally located pivot axes.

* * * * *